US009284144B2

(12) United States Patent
Hayes et al.

(10) Patent No.: US 9,284,144 B2
(45) Date of Patent: Mar. 15, 2016

(54) VALIDATOR WITH A DYNAMIC DOCUMENT PATH HEIGHT

(71) Applicant: MEI, Inc., Malvern, PA (US)

(72) Inventors: Michael A. Hayes, Wayne, PA (US); Philippe Jard, Malvern, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 82 days.

(21) Appl. No.: 14/167,319

(22) Filed: Jan. 29, 2014

(65) Prior Publication Data

US 2015/0210495 A1 Jul. 30, 2015

(51) Int. Cl.

| | |
|---|---|
| ***B65H 5/02*** | (2006.01) |
| ***B65H 7/06*** | (2006.01) |
| ***B65H 7/14*** | (2006.01) |
| ***B65H 5/06*** | (2006.01) |
| ***B65H 5/26*** | (2006.01) |
| ***B65H 29/58*** | (2006.01) |

(52) U.S. Cl.

CPC ..... *B65H 7/06* (2013.01); *B65H 5/023* (2013.01); *B65H 5/062* (2013.01); *B65H 5/26* (2013.01); *B65H 7/14* (2013.01); *B65H 29/58* (2013.01)

(58) Field of Classification Search

CPC ..... B65H 5/023; B65H 5/062; B65H 5/36; B65H 7/06; B65H 29/12; B65H 29/125; B65H 2301/1421; B65H 2301/212; B65H 2301/31; B65H 2301/311; B65H 2301/3115; B65H 2404/69; B65H 2404/693; B65H 2511/13

USPC ..... 271/258.01, 262, 263, 259, 265.01, 271/265.02, 265.04, 264, 272, 176

See application file for complete search history.

(56) References Cited

U.S. PATENT DOCUMENTS

| | | | | |
|---|---|---|---|---|
| 5,615,280 | A | 3/1997 | Izawa et al. | |
| 7,784,787 | B2 * | 8/2010 | Ugo et al. | 271/265.04 |
| 7,896,344 | B2 | 3/2011 | Nakada et al. | |
| 8,157,078 | B1 | 4/2012 | Folk et al. | |

FOREIGN PATENT DOCUMENTS

| | | | |
|---|---|---|---|
| EP | 1764751 | A1 | 3/2007 |
| EP | 2196421 | A1 | 6/2010 |
| WO | WO-9312022 | A1 | 6/1993 |

* cited by examiner

*Primary Examiner* — David H Bollinger

(57) ABSTRACT

A document validator includes a sensor, a transportation unit, an actuator, and a controller. The transportation unit is adjacent the sensor and has a document path, at least a portion of which has an adjustable path height. The transportation unit is configured to transport a document from a first location past the sensor to a second location. The actuator is operable to transition the adjustable path height between a first path height and a second path height different from the first path height. The controller is configured to automatically cause the actuator to transition the adjustable path height between the first path height and the second path height. Related apparatus, systems, techniques, and articles are also described.

24 Claims, 6 Drawing Sheets

VALIDATOR WITH A DYNAMIC DOCUMENT PATH HEIGHT

TECHNICAL FIELD

The subject matter described herein relates to a document validator that controls and/or dynamically adjusts a document path height.

BACKGROUND

A document or currency validator is a device that determines whether checks or bank-note bills are genuine or counterfeit. These devices are used in many automated machines found in retail kiosks, self-checkout machines, gaming machines, transportation parking machines, automatic fare collection machines, vending machines, and the like.

Validation of a document can involve examining the document that has been inserted, and determining if the document is counterfeit. In operation, if the item is accepted it can be retained by the machine and can be placed in a storage container for later collection. If the item is rejected, the machine can return the item.

SUMMARY

In an aspect, a document validator includes a sensor, a transportation unit, an actuator, and a controller. The transportation unit is adjacent the sensor and has a document path, at least a portion of which has an adjustable path height. The transportation unit is configured to transport a document from a first location past the sensor to a second location. The actuator is operable to transition the adjustable path height between a first path height and a second path height different from the first path height. The controller is configured to automatically cause the actuator to transition the adjustable path height between the first path height and the second path height.

In another aspect, using a document validator includes receiving a document at an entrance of a document path, at least a portion of which has an adjustable path height. Using an actuator, the adjustable path height is transitioned from a first document path height to a second document path height. The document is transported from the entrance of the document path through the document path and past a sensor taking one or more measurements of the document.

One or more of the following features can be included. For example, the controller can be further configured to dynamically transition the adjustable path height between a plurality of different path heights. The transportation unit can be configured to detect a document jam event and provide a jam event signal to the controller. The controller can be configured to cause the actuator to transition the first path height to the second path height and clear a jam, the second path height being larger than the first path height. The controller can be configured to receive data characterizing a type of document in the document path and automatically cause the actuator to transition the adjustable path height based on the type of document in the document path.

The type of document in the document path can be one of a banknote and a check. The controller can be configured to receive calibration measurements; compute, based on the received calibration measurements, a third path height that is different from the first path height and the second path height; and cause the actuator to transition the adjustable path height to the third path height. The calibration measurements can be received from the sensor.

The document validator can include a document height sensor to measure a thickness of the document. The controller can be configured to compute, based on the measured thickness of the document, a third path height that is different from the first path height and the second path height and cause the actuator to transition the adjustable path height to the third path height.

The sensor can include one or more of a contact imaging sensor and a magnetic sensor. The document path can include a lower-path, an upper-path, and a ramp on the lower-path. The ramp can be coupled to the actuator, adjacent the sensor, and when actuated by the actuator, can move towards or away from the upper-path. A distance between the ramp and the upper-path can define the adjustable path height of the document path. The transportation unit can include one or more belts for moving the document. The transportation unit can include a plurality of rollers for moving the document.

Using a controller, the second document path height can be determined. A document jam event can be detected and transitioning the adjustable path height can occur in response to the detection of the document jam event. Transitioning the adjustable path height can occur in response to a type of the document received at the entrance of the document path. Transitioning the adjustable path height can occur in response to a document height sensor measuring a thickness of the received document.

The second document path height can be determined based on a required accuracy of the sensor measurements. Multiple calibration measurements can be acquired using a sensor. The second document path height can be determined based on the acquired calibration measurements. Transporting the document can be by one or more belts. Transporting the document can be by a plurality of rollers.

Computer program products are also described that comprise non-transitory computer readable media storing instructions, which when executed by at least one data processors of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Figure 1:
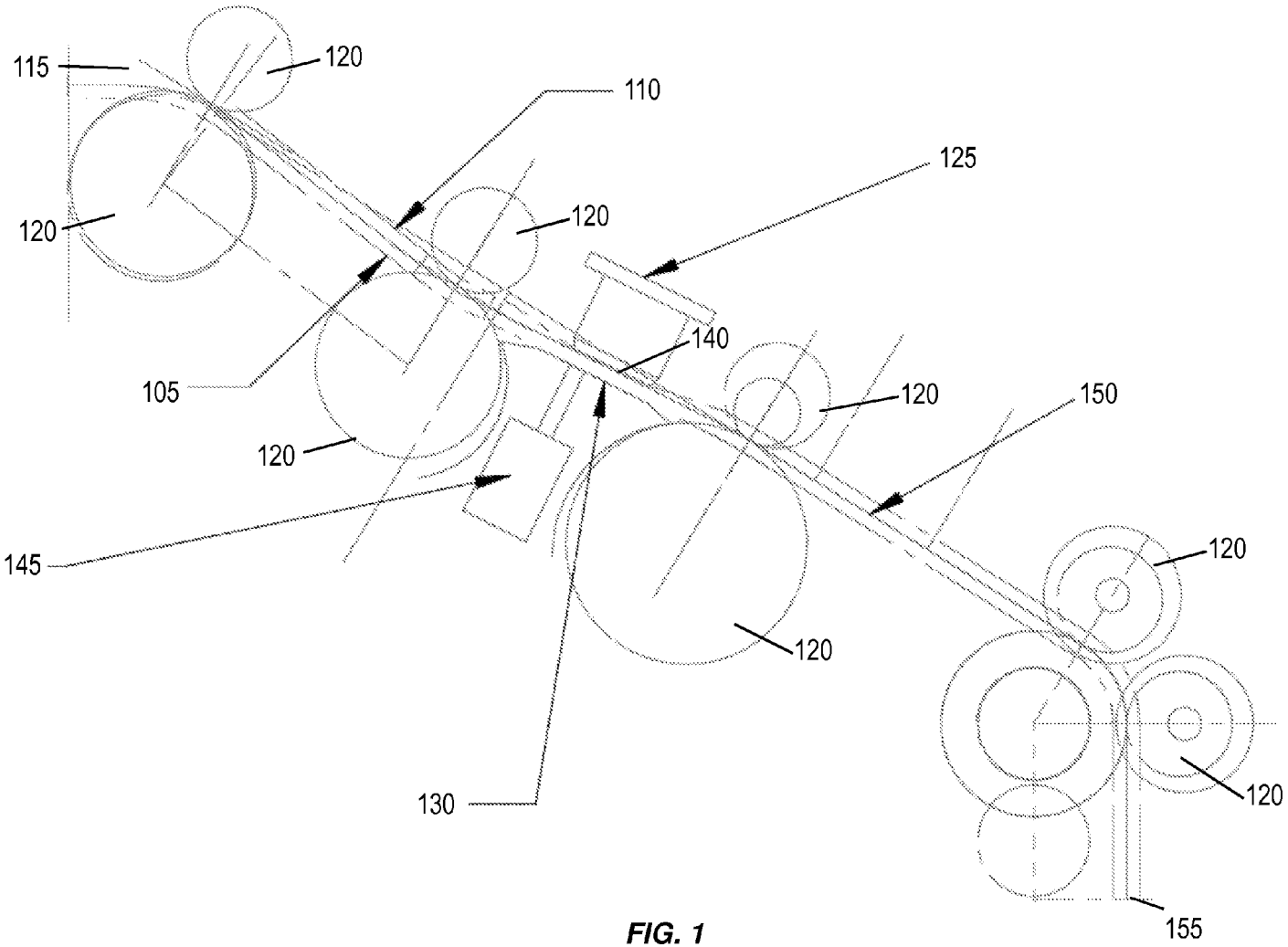
FIG. 1 is a cross-section of an example implementation of a document path in a document validator with an automatically adjusting document path height.

The current subject matter described herein generally relates to a document validator that is configured to automatically and/or dynamically adjust at least a portion of its document path height. The path or corridor along which the document travels can be referred to as the document path. The document path has a width and a height. The width is typically wider than the document, and the height is typically greater than the thickness of the document.

Document validators can operate by receiving a document, for example a banknote, bill, or check and transporting the document through the document path, past a sensor, and into a storage compartment. The sensor can take measurements of the document and can use the measurements to validate the document as real or counterfeit and/or to classify the document, for example, as a certain currency denomination. The document path can comprise a number of elements. For example, the document path can include a pair of roughly parallel surfaces through which belts, rollers, and sensors protrude. The belts, rollers, and/or sensors can define the path and the maximum path height. In other example implementations, the path height may be determined by a combination of belts, rollers, sensors and other surfaces that can guide the document past the sensors and through the device.

Document path height can affect a range of document validator functions, and therefore a document validator with a dynamic document path height can provide many advantages. For example, the type of sensor (e.g., optical, magnetic, capacitive, and the like) used to measure the document can require differing field of view depths, which can be adjusted by adjusting the document path height. Larger document path height can reduce the number of jam events, while a smaller document path height can increase the accuracy of the sensors used to validate the document. A document validator that can dynamically adjust its document path height can achieve advantages of both a large and small document path height.

A document validator with an adjustable and dynamic document path height can adjust the document path height in a number of circumstances. For example, in response to a jam event, the document path height can increase and the document can be rejected from the document validator. As another example, changing the document path height adjusts the depth of field of view of a sensor (e.g., optical sensor or magnetic), which, in turn, affects accuracy of sensor measurements. For a given situation or sensor, a required accuracy can be met by adjusting the document path height accordingly. The document validator can adjust the document path height during a sensor calibration mode of operation to improve a probability of correctly classifying received items. As yet a further example, the document path height can adjust based on an intended application of the document validator or the type of item that is received. For example, the document path height can change based on whether a bank-note or a check is inserted into the document validator. The document validator is not limited to bank notes, but can include other documents such as checks, coupons, certificates, and other items of value.

FIG. 1 is a cross-section of an example implementation of a document path in a document validator, the document path having an automatically adjusting document path height. The path a document 150 travels can be defined by at least a lower-path 105 (e.g., a floor) and an upper-path 110 (e.g., a ceiling). A document 150 can enter the path at a path entrance 115 and can be moved by rollers 120 along the path to path exit 155. The document 150 can pass a sensor 125, which can be adjacent the path and can be integral with or form part of the upper-path 110, although other sensor locations are possible. A ramp 130, which can be integral with or form part of the lower-path 105, can be arranged opposite the sensor 125, although other ramp locations are possible. In some implementations, the ramp 130 can form the entire lower-path 105. A distance between the ramp 130 and a face 140 of the sensor 125 (or the upper-path 110) can define a document path height. The ramp 130 can move towards and/or away from the upper-path 110 thereby making a portion of the document path have an adjustable path height. In the example implementation illustrated in FIG. 1, the ramp 130 includes angled (or ramped) portions to transition the document path height between different heights. The ramp 130 can be connected to or coupled to an actuator 145 to enable movement of the ramp 130. The actuator 145 can include, for example, a solenoid, motor or other electro mechanical mechanism. In some implementations, the actuator can include a directional driven clutch, which causes the ramp to transition when the belts, rollers, or other transporting element changes direction of the bill (e.g., operates in reverse to return, reject, or dispense the document). In FIG. 1, the ramp 130 is illustrated in a lowered position substantially flush with the lower-path 105. In the example implementation the ramp 130 is lowered, which results in a relatively large document path height at the ramp 130 portion of the path.

Figure 2:
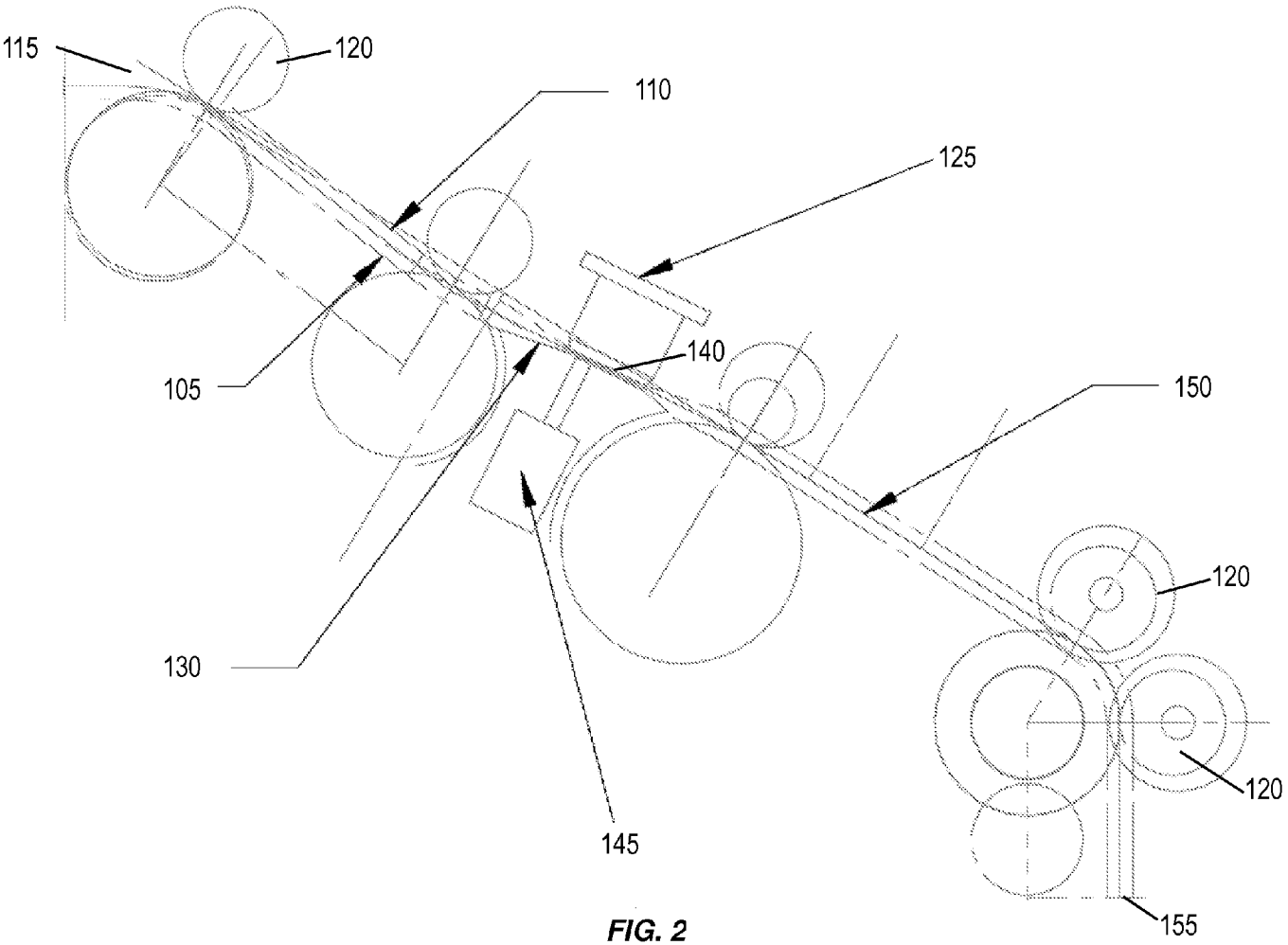
FIG. 2 is a cross-section of the example implementation of a document validator with an automatically adjusting document path height as shown in FIG. 1, with the ramp in a raised positioned.

FIG. 2 is a cross-section of the example implementation of a document validator with an automatically adjusting document path height as shown in FIG. 1, with the ramp 130 in a raised positioned. In the illustrated raised position, the ramp 130 is pressing the document 150 against the face 140 of the sensor 125. The ramp 130 can transition between the lowered position (FIG. 1) and raised position (FIG. 2). In some implementations the ramp 130 can be positioned at any location between the illustrated lowered and raised positions. Thus, the document path height of at least a portion of the path can be varied to any desired height.

Figure 3:
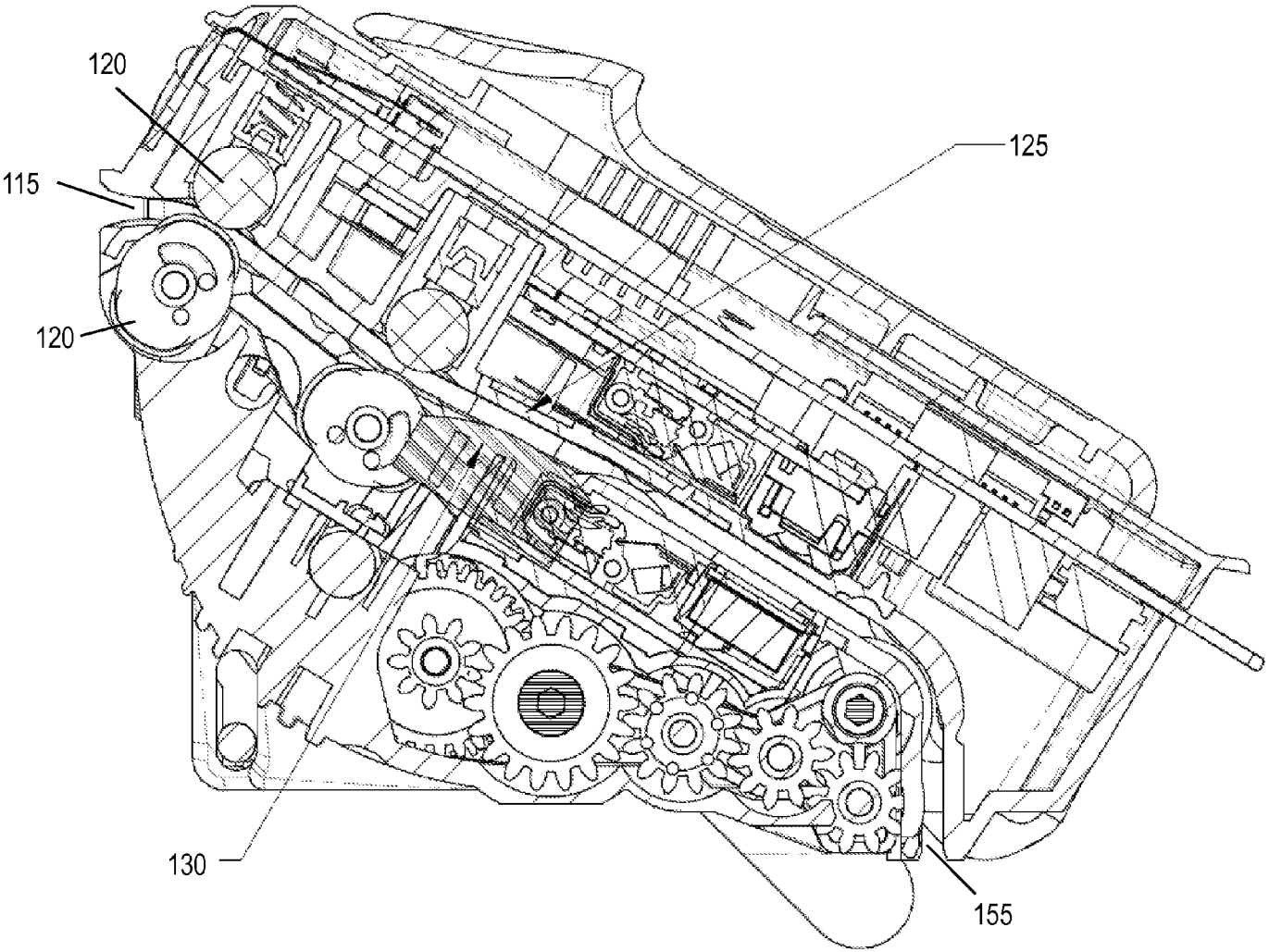
FIG. 3 is a cross-section of the example implementation of the document validator.
Figure 4:
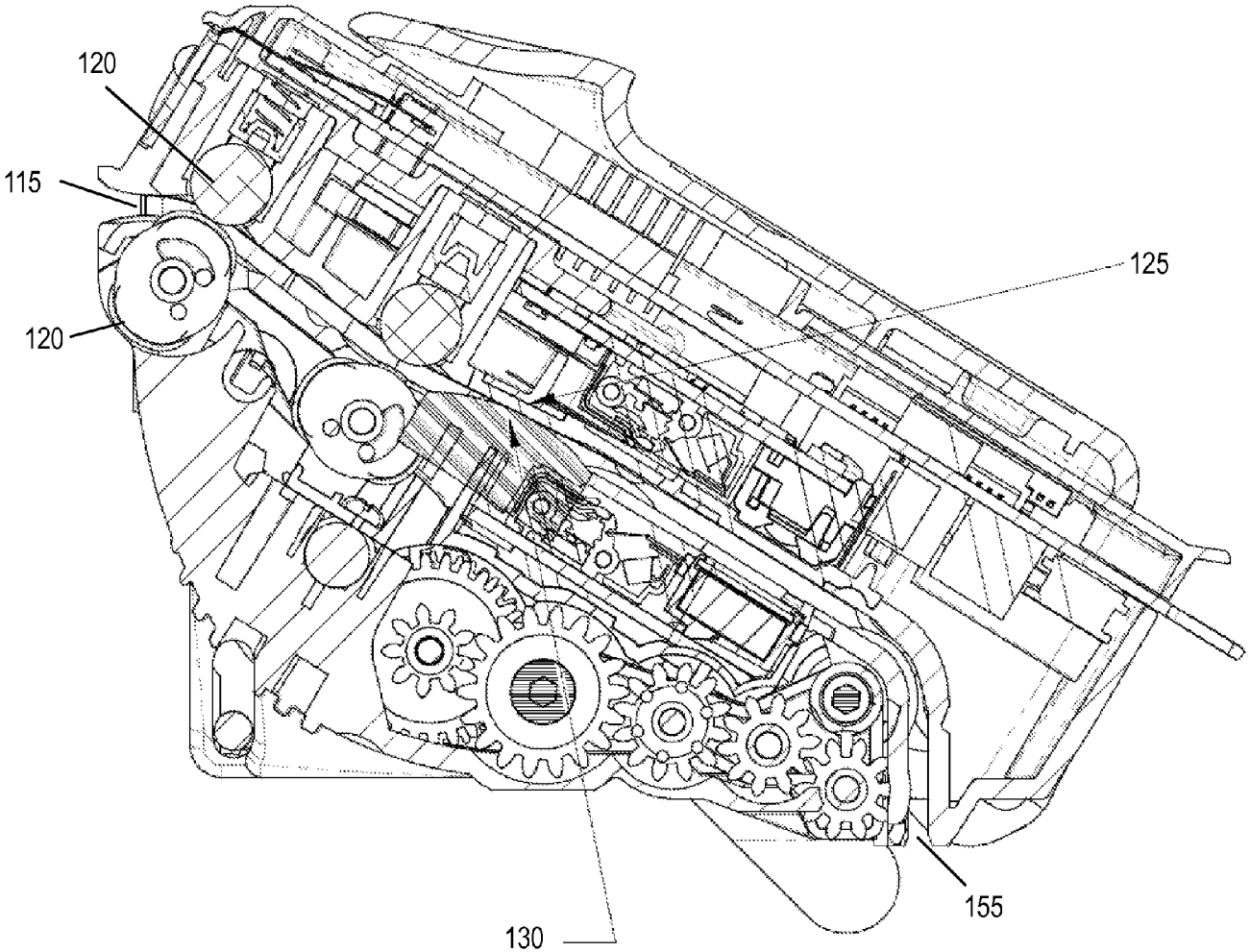
FIG. 4 is a cross-section of the example implementation of the document validator as shown in FIG. 3, with the ramp in a raised position.

FIG. 3 is a cross-section of the example implementation of the document validator. The document path is shown between the entrance 115 and exit 155, as well as the ramp 130 adjacent the sensor 125. The ramp 130 is illustrated in a lowered position. A document 150 is not illustrated in FIG. 3. FIG. 4 is a cross-section of the example implementation of the document validator as shown in FIG. 3, with the ramp 130 in a raised position. In the raised position, the ramp 130 can press the document 150 against the face 140 of the sensor 125, although a document 150 is not illustrated in FIG. 4.

Although in the example implementation described herein rollers 120 are used to transport a document down the document path, other transport mechanisms or techniques may be used, for example, bands or belts.

Figure 5:
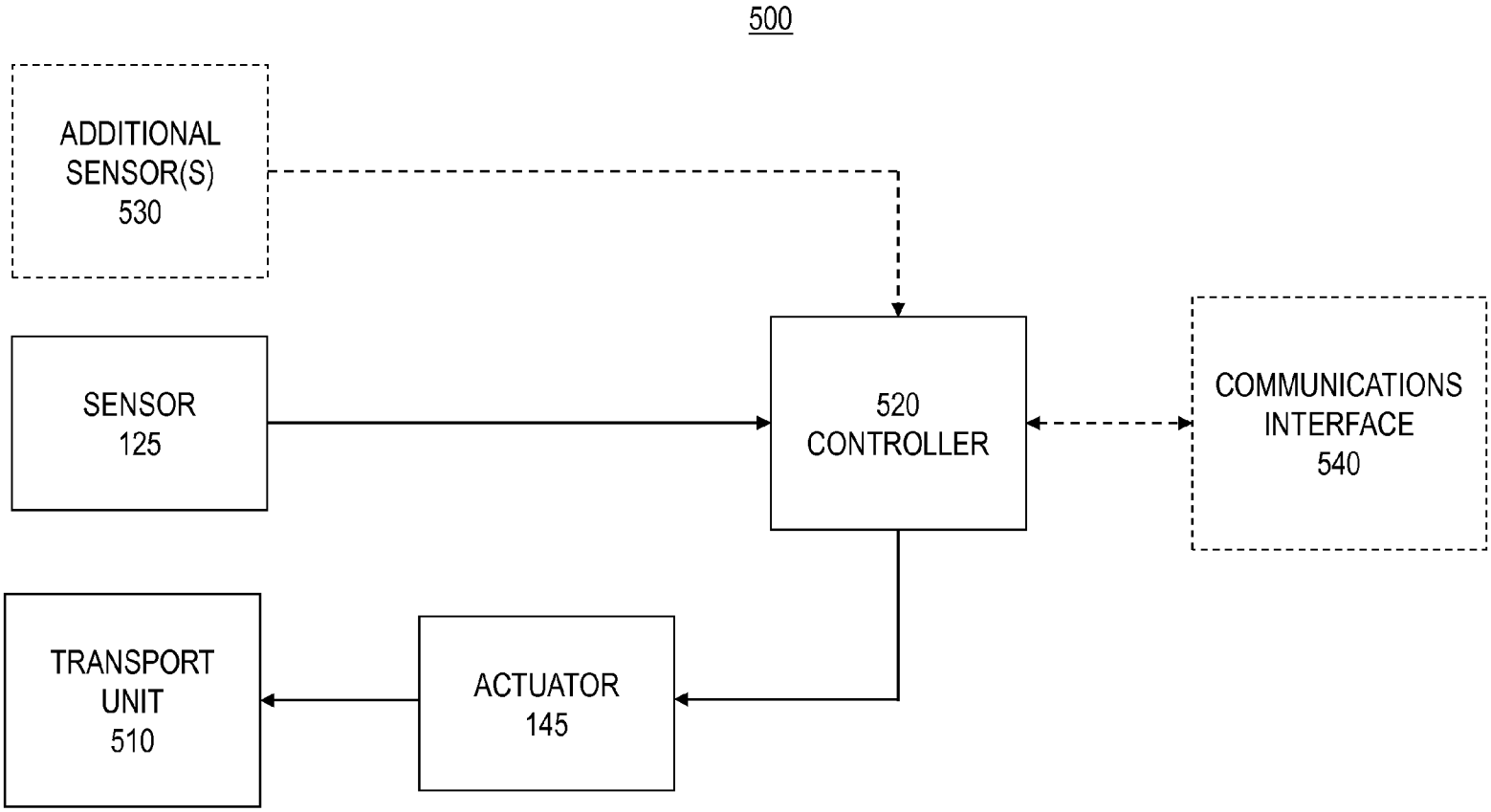
FIG. 5 is a system block diagram of an example implementation of a document validator including a sensor, transportation unit, an actuator, and a controller.

FIG. 5 is a system block diagram 500 of an example implementation of a document validator including a sensor 125, transportation unit 510, an actuator 145, a controller 520, optional additional sensor(s) 530, and an optional communications interface 540. The transportation unit 510 has a document path (for example, as described with reference to FIG. 1 and FIG. 2) with a document path height. The transportation unit 510 is configured to transport the document from an input or entrance past the sensor 125 to an output or path exit 155 (for example, into a storage container). The transportation unit 510 can be coupled to the actuator 145, which is operable to transition the path height of at least a portion of the path of the transportation unit 510. The actuator 145 can be coupled to or connected to a controller 520. The optional additional sensor(s) 530 can include one or more additional sensors coupled to the controller such as a document jam sensor, and/or a document height sensor. The optional communications interface 540 can include an interface for a wired or wireless network (e.g., Ethernet, cellular, and the like).

The optional communications interface 540 can facilitate communications between the bill validator and other portions of a machine in which the bill validator is installed (e.g., a vending machine or automatic teller machine), such as a user-interface. The other portions of the machine can provide information such as the type of document to be inserted into the document validator. The communications interface 540 can facilitate communications between the document validator and other entities beyond the machine in which the document validator is installed, such as a control and configuration center. Instructions from the control and configuration center can be received by the bill validator using the communications interface 540.

The controller 520 can be configured to automatically cause the actuator 145 to transition the path height. The controller 520 can transition the path height in response to events or conditions occurring in the document validator. For example, a document 150 of poor quality, high level of wear, or a counterfeit document can become jammed in the transportation unit 510, preventing the transportation unit 510 from moving the document 150 and effectively placing the document validator out of order. The controller 520 can be configured to receive a signal (from, e.g., the transportation unit 510 or a jam sensor) indicating an occurrence of a jam event, and, based on the occurrence of the jam event, increase the path height.

The controller 520 can be configured to detect, based on a received sensor signal, whether a jam event has occurred. Jam events can be detected by, for example, use of optical progress sensors. An optical progress sensor can include a light source and photo-detector pair. The controller can know that the document should be moving in a specific direction at a specific speed. The "progress" or "recognition" sensors should be blocked or clear at specific times. If they are not, then the controller 520 can determine that the document 150 is not moving correctly (e.g., jammed). As another example, the controller 520 can detect jam events by monitoring a drive motor current. The drive motor can actuate the rollers or belts of the transportation unit 510. If the drive motor current exceeds a predetermined value, the document 150 may be jammed. Additional jam sensors can include a roller that is driven by a motion of the document 150 traveling down the document path. The controller 520 can detect a jam event if the roller is not moving or not moving at the correct rate. In this example,"motion" detectors can be used, such as optical sensors typically found in an optical computer mouse. Once a jam is detected, increasing the path height can increase the likelihood that the transportation unit 510 can subsequently clear the jammed document and return to normal operating status.

As another example, in an example implementation, the controller 520 can transition the path height based on the type of document inserted or intended to be inserted into the document validator. Ideal path heights for a given type of document can be predetermined and may be stored in a memory of the controller 520 (e.g., the controller 520 can adjust the document path height to a first path height for dollars, a second path height for Euros, a third path height for checks, etc.) Document types can include, for example, currency, checks, coupons, certificates. The type of document may include the type of currency (e.g., dollars, euro's, etc.). The type of document inserted into the document validator can be received by a user input, can be measured, or can be preconfigured based on an intended application. For example, the document validator can be configured prior to deployment based on whether the document validator is intended to accept dollars or euros. The document validator can be reconfigured by a technician or remotely. For example, the controller 520 can receive a configuration instruction sent from a central control and configuration center to a document validator through a communications network.

In an example implementation, the controller 520 can transition the path height based on a document height. The document height can be determined, for example, from the type of document inserted, or can be measured when the document is inserted into the document validator. For example, document height can be measured by a mechanical lever or roller that presses the document 150 against an opposing surface, lever, or roller. The lever or roller connects to a measuring device like an optical encoder or a strain gauge, which determines the thickness of the document. Alternative electronic devices can be used, such as optical or capacitive measurement devices. The document height can be measured with a document height sensor, which is different from sensor 125.

In an example implementation, the controller 520 can transition the path height based on the type of sensor and/or a desired accuracy of the sensor 125. The sensor 125 can be optical and/or magnetic. The accuracy of measurements taken by sensor 125 can depend on the distance between the face 140 of the sensor 125 and the document 150. Typically, the closer the document 150 is to the face 140 of the sensor 125, the greater the accuracy of the obtained measurements. The controller 520 can adjust the path height to control the distance and, as a result, control an accuracy of the sensor 125 measurements. Required accuracy can vary based on the type of document inserted or the type of sensor used. For example, contact imaging sensors may require the document 150 to be in contact with or very near the face 140 of the sensor in order to acquire measurements of sufficient accuracy for classification of the document.

In an example implementation, the document validator can conduct a calibration procedure to determine an optimal or desired document path height. A calibration procedure can accommodate for unit-to-unit engineering differences or tolerances introduced during manufacture. In an example implementation, to calibrate the document validator, a known calibration document can be inserted, or the ramp 130 can include a portion with known optical or magnetic characteristics. Multiple measurements obtained by the sensor 125 and sent to the controller 520 can be used by the controller 520 to determine an optimal document path height.

Figure 6:
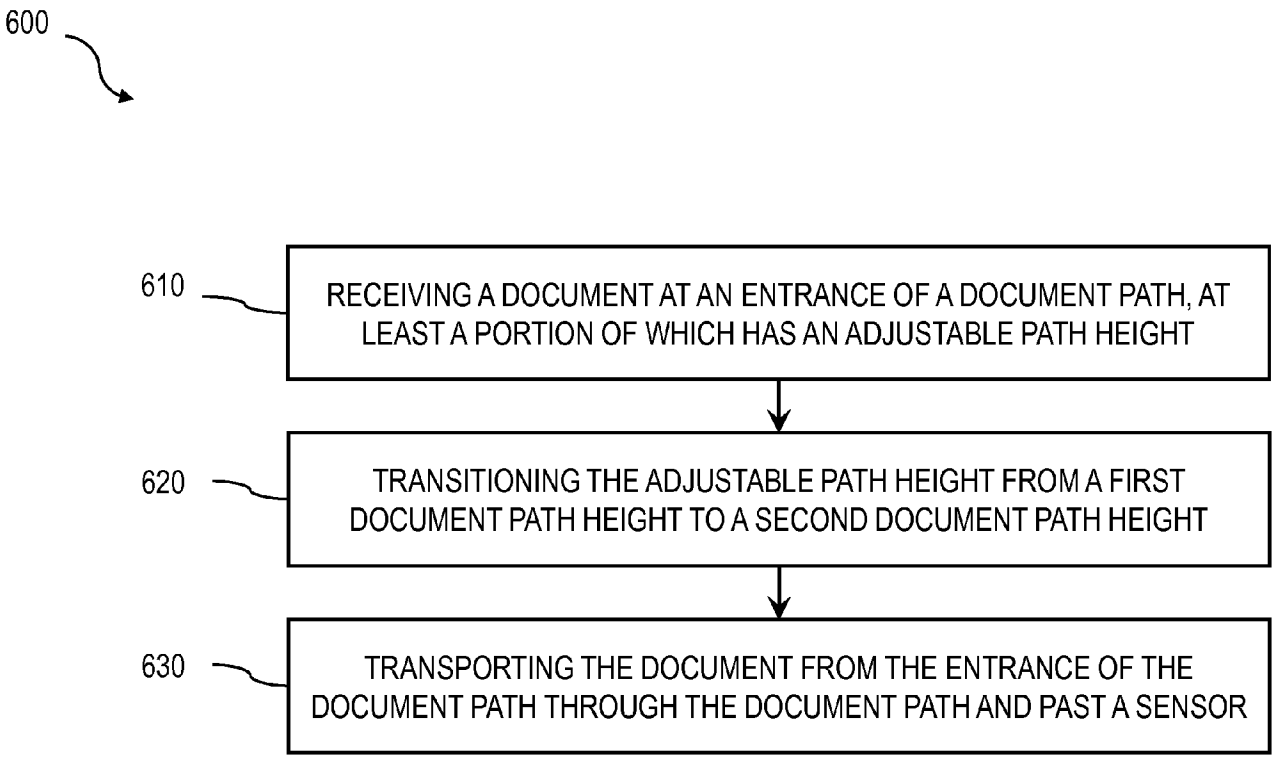
FIG. 6 is a process flow diagram of a method of using a document validator.

FIG. 6 is a process flow diagram 600 of a method of using a document validator. At 610, a document is received at an entrance 115 of a document path. At least a portion of the document path has an adjustable path height. At 620, the adjustable path height is transitioned, using an actuator 125, from one document path height to another, different document path height. At 630, the document is transported from the entrance 115 of the document path through the document path and past a sensor 125 taking one or more measurements of the document. The second path height can be determined.

Transitioning the adjustable path height can occur in response to a document jam event, a type of document received at the entrance of the document path, or a measured thickness of the received document. The second path height can be determined based on a required accuracy of the sensor measurements. Multiple calibration measurements can be acquired using the sensor and the second path height can be determined based on the acquired calibration measurements. Additionally, the controller 520 can dynamically adjust the path height based on analysis of signals received from any of sensors (125 and/or 130). For example, the controller 520 can dynamically analyze the focus of a CIS sensor and adjust the path height accordingly. As a second example, the controller 520 can dynamically analyze an average intensity received at one or more optical sensors. As a third example, the controller 520 can dynamically analyze the relative signal strength of a magnetic or capacitive sensor.

In some implementations, more than one location in the bill path can transition. Such an implementation can include, for example, multiple sensors and multiple ramps, which are configured to transition bill path height at a corresponding location in the bill path.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

The subject matter described herein may be implemented in a computing system that includes a back-end component (e.g., as a data server), or that includes a middleware component (e.g., an application server), or that includes a front-end component (e.g., a client computer having a graphical user interface or a Web browser through which a user may interact with an implementation of the subject matter described herein), or any combination of such back-end, middleware, or front-end components. The components of the system may be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

Although a few variations have been described in detail above, other modifications are possible. For example, the logic flow depicted in the accompanying figures and described herein do not require the particular order shown, or sequential order, to achieve desirable results. Other embodiments may be within the scope of the following claims.

What is claimed is:

1. A document validator comprising:

a transportation unit comprising a document path, wherein at least a portion of the document path has an adjustable path height, wherein the transportation unit is configured to transport a document from a first location past a sensor to a second location;

an actuator configured to transition the adjustable path height between a plurality of different path heights including a first path height and a second path height different from the first path height; and a controller configured to automatically cause the actuator to transition the adjustable path height between the first path height and the second path height.

2. The document validator of claim 1, wherein in response to detecting an occurrence of a document jam in the transportation unit, the controller is configured to cause the actuator to transition the first path height to the second path height clear the document jam, and wherein the second path height is higher than the first path height.

3. The document validator of claim 2, further comprising an additional sensor configured to detect the occurrence of the document jam.

4. The document validator of any of claim 1, wherein the controller is configured to receive data characterizing a type of document in the document path and automatically cause the actuator to transition the adjustable path height as a function of the type of document in the document path.

5. The document validator of claim 4, wherein the type of document in the document path is one of a banknote and a check.

6. The document validator of claim 1, wherein the controller is configured to receive calibration measurements; compute, based on the received calibration measurements, a third path height that is different from the first path height and the second path height; and cause the actuator to transition the adjustable path height to the third path height.

7. The document validator of claim 6, wherein the calibration measurements are received from the sensor.

8. The document validator of claim 1, further comprising an additional sensor configured to measure a document thickness, wherein the controller is configured to compute, based on the measured thickness of the document, a third path height that is different from the first path height and the second path height; and cause the actuator to transition the adjustable path height to the third path height.

9. The document validator of claim 1, wherein the sensor comprises at least one of an imaging sensor or a magnetic sensor.

10. The document validator of claim 1, wherein the document path includes a lower-path, an upper-path, and a ramp on the lower-path, wherein the ramp is coupled to the actuator, and wherein the actuator is configured to move the ramp towards the upper-path or away from the upper-path.

11. The document validator of claim 10, wherein the adjustable path height of the document path is determined as a function of a distance between the ramp and the upper-path.

12. The document validator of claim 1, wherein the transportation unit further comprises a plurality of rollers configured to move the document.

13. The document validator of claim 1, wherein the transportation unit comprises the sensor.

14. A method implemented using a document validator, the method comprising:

receiving a document at an entrance of a document path, wherein at least a portion of the document path has an adjustable path height;

determining a second document path height of the document path;

transitioning, using an actuator, the adjustable path height from a first document path height to the second document path height; and transporting the document from the entrance of the document path through the document path and past a sensor configured to sense one or more parameters of the document.

15. The method of claim 14, further comprising in response to detecting an occurrence of a document jam along the document path, changing the adjustable path height.

16. The method of claim 15, further comprising detecting, using an additional sensor of the document validator, the occurrence of the document jam.

17. The method of claim 14, wherein the adjustable path height changes as a function of a document type of the document received at the entrance of the document path.

18. The method of claim 14, wherein the adjustable path height changes as a function of a document thickness of the document received at the entrance of the document path.

19. The method of claim 18, further comprising measuring, using an additional sensor of the document validator, the document thickness of the document received at the entrance of the document path.

20. The method of claim 14, further comprising:

determining the second document path height as a function of a required accuracy of the sensor measurements.

21. The method of claim 14, further comprising:

acquiring multiple calibration measurements using a sensor; and determining the second document path height as a function of the acquired calibration measurements.

22. The method of claim 14, wherein the document path includes a lower-path, an upper-path, and a ramp on the lower-path, and further comprising moving the ramp towards the upper-path or away from the upper-path when transitioning the adjustable path height.

23. The method of claim 22, further comprising determining the adjustable path height of the document path as a function of a distance between the ramp and the upper-path.

24. The method of claim 22, wherein transporting the document from the entrance of the document path through the document path and past the sensor comprising transporting the document using a plurality of rollers.

* * * * *